US005536195A

United States Patent [19]

Stamos

[11] Patent Number: 5,536,195

[45] Date of Patent: Jul. 16, 1996

[54] ILLUMINATED FLYING DISC

[76] Inventor: Bryan W. Stamos, 900 Pinot Noir, Lodi, Calif. 95240

[21] Appl. No.: 419,891

[22] Filed: Apr. 11, 1995

Related U.S. Application Data

[63] Continuation-in-part of Ser. No. 321,249, Oct. 11, 1994, abandoned.

[51] Int. Cl.[6] ..... A63H 27/00

[52] U.S. Cl. ..... 446/48; 446/219; 446/46

[58] Field of Search ..... 446/46–48, 219; 273/424, 425, 428

[56] References Cited

U.S. PATENT DOCUMENTS

| | | | |
|---|---|---|---|
| D. 209,763 | 1/1968 | Mueller | 446/48 X |
| 3,948,523 | 4/1976 | Michael | 446/47 X |
| 4,086,723 | 5/1978 | Stawick | 446/47 |
| 4,204,357 | 5/1980 | Harrington | 446/47 |
| 4,207,702 | 6/1980 | Boatman et al. | 446/48 |
| 4,254,575 | 3/1981 | Gould | 446/46 |
| 4,515,570 | 5/1985 | Beltran | 446/47 |
| 5,181,876 | 1/1993 | Chen et al. | 446/46 X |

*Primary Examiner*—Mickey Yu
*Attorney, Agent, or Firm*—Thomas R. Lampe

[57] ABSTRACT

An amusement and recreational apparatus includes an aerodynamic flying disc having a top wall and one or more openings formed in the top wall. One or more containers are releasably connected to the top wall and project through one or more openings. The container has a curved, aerodynamic, light-transmitting container wall located above the top wall. Chemiluminescent liquid material within the container interior provides a light display above the top wall of the flying disc.

12 Claims, 5 Drawing Sheets

ILLUMINATED FLYING DISC

This application is a continuation-in-part of U.S. patent application Ser. No. 08/321,249, filed Oct. 11, 1994, abandoned.

TECHNICAL FIELD

This invention relates to an amusement and recreational apparatus, more particularly to an aerodynamic flying disc to be launched by hand and structure for illuminating the flying disc. The apparatus includes a container releasably attached to the flying disc having chemiluminescent liquid material within the interior thereof. Rotation of the flying disc serves to agitate the luminescent liquid material, and the light generated by the chemiluminescent liquid material is visually perceived during flight of the disc.

BACKGROUND ART

Hand thrown or launched flying discs have been utilized for amusement and recreation for many years. The aerodynamic designs of such discs permit them to be thrown for long distances and their flight patterns controlled when hand launched by a skilled user.

It is known to incorporate phosphorescent chemicals in the material, usually plastic, from which flying discs are formed, and it is also known to imprint phosphorescent graphics on the disc. Such arrangements, however, have deficiencies, including the necessity of "charging" the phosphorescent materials with light prior to uses. Furthermore, a low light level is produced.

Applicant is aware of the existence of prior art arrangements which utilize containers holding chemiluminescent material affixed to flying discs. However, such prior art arrangements can impair flying disc flight performance and do not provide the dramatic light display presented by the invention disclosed herein.

The following patents are believed representative of the current state of the prior art in this field: U.S. Pat. No. 4,207,702, issued Jun. 17, 1980, U.S. Pat. No. 5,181,876, issued Jan. 26, 1993, U.S. Pat. No. 4,515,570, issued May 7, 1985, U.S. Pat. No. 4,086,723, issued May 2, 1978, U.S. Pat. No. 4,204,357, issued May 27, 1980, U.S. Pat. No. 4,254,575, issued Mar. 10, 1981, and U.S. Pat. No. Des. 209,763, issued Jan. 2, 1968.

DISCLOSURE OF INVENTION

The present invention relates to an arrangement which will illuminate flying discs so that they can be used at night or in dark environs. Furthermore, the illumination presents an attractive and captivating appearance during flight. Of course, another advantage of illumination is that it lessens the chances of losing the disc under low-light or no-light conditions. The arrangement will not adversely affect flight performance of the disc.

The amusement and recreational apparatus of the present invention includes an aerodynamic flying disc including a flying disc top wall having a circular-shaped outer periphery and a round, continuous side wall extending downwardly from the circular-shaped outer periphery of the flying disc top wall. The flying disc side wall and flying disc top wall define a flying disc interior. The flying disc top wall defines at least one opening communicating with the interior.

At least one container is releasably connected to the flying disc top wall and projects through the at least one opening. The container has a curved, aerodynamic, light transmitting container wall disposed above the top wall and a container interior closed to ambient atmosphere at least partially defined by the curved, aerodynamic, light transmitting container wall.

Chemiluminescent liquid material is within the container interior, rotation of the flying disc rotating the container and agitating the chemiluminescent liquid material in the closed interior of the container to provide a light display above the flying disc top wall.

In a preferred embodiment, the flying disc top wall defines a plurality of spaced openings. The container comprises a flexible, double-ended tube woven through at least two of the spaced openings whereby the flexible, double-ended tube is observable from both above and below the flying disc top wall.

Other features, advantages, and objects of the present invention will become apparent with reference to the following description and accompanying drawings.

BEST MODE FOR CARRYING OUT THE INVENTION

Figure 1:
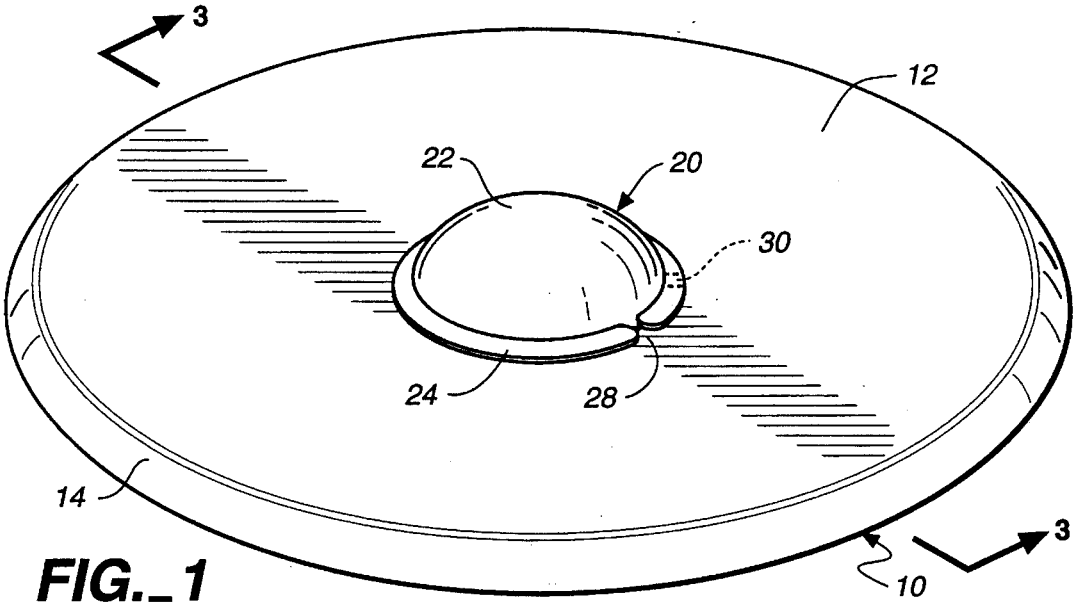
FIG. 1 is a perspective view of a container and flying disc constructed in accordance with the teachings of the present invention.
Figure 2:
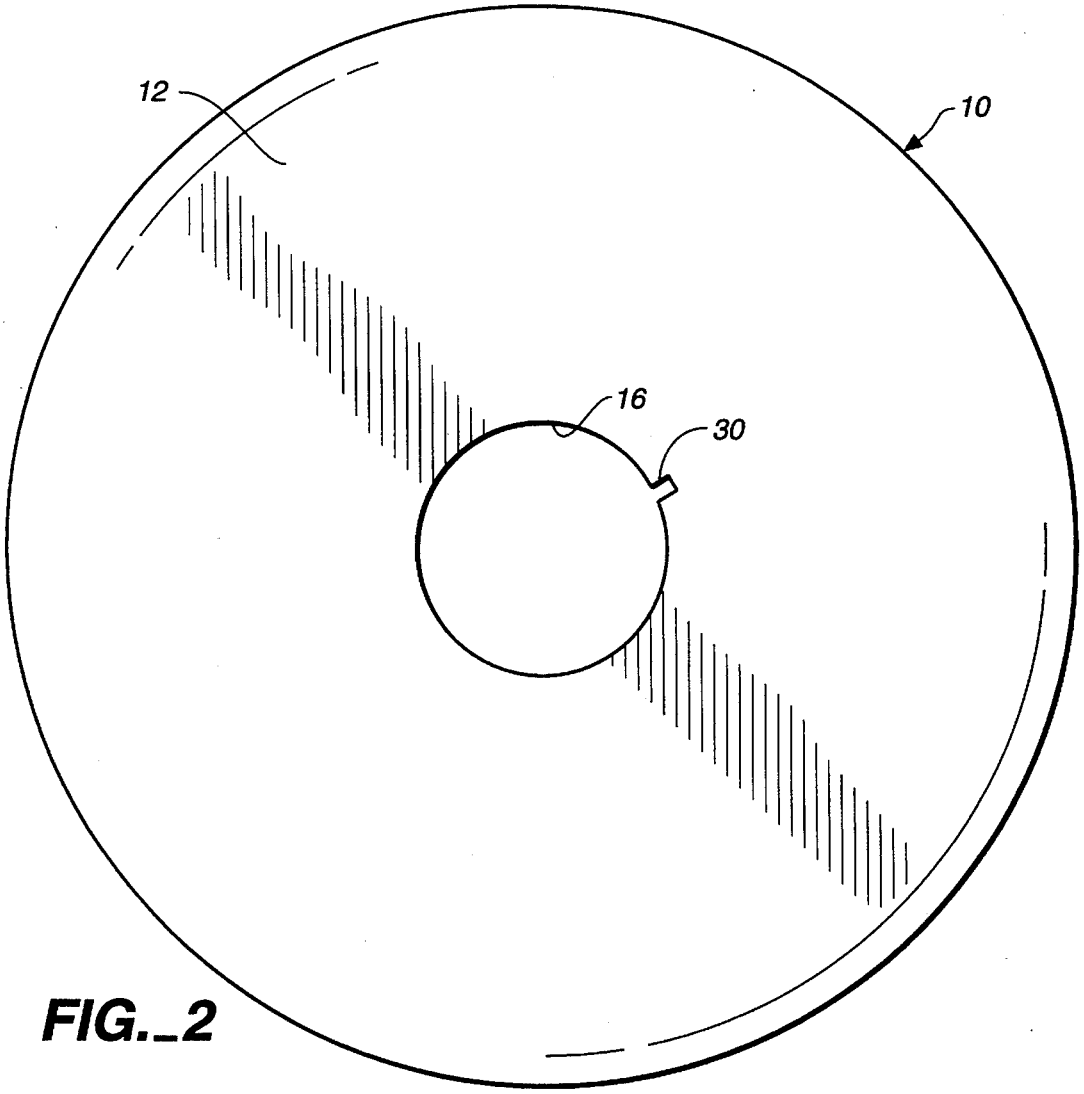
FIG. 2 is a top plan view of the flying disc of FIG. 1.

FIGS. 1–4 illustrate one form of apparatus constructed in accordance with the teachings of the present invention. More particularly, the apparatus includes an aerodynamic flying disc 10 having a top wall 12 with a circular-shaped outer periphery and a round, continuous side wall 14 extending downwardly from the circular-shaped outer periphery of the top wall. Together, the top wall and side wall define a flying disc interior.

At the center of the flying disc, the top wall has an opening 16 therein communicating with the interior of the flying disc under the top wall.

A container 20 is releasably connected to the top wall and projects through opening 16. Container 20 has a curved, aerodynamic, light transmitting container wall 22 of domelike configuration disposed above the top wall. The interior of container 20 is closed to the ambient atmosphere.

The container 20, in essence, comprises a plug which is frictionally secured to the flying disc at the center of rotation of the flying disc. In the arrangement illustrated, the means for accomplishing such interconnection comprises spaced ribs 24, 26 extending about the dome-shaped wall 22. The top most rib, rib 24, defines a space 28 so that the rib 24 has spaced distal ends.

Figure 3:
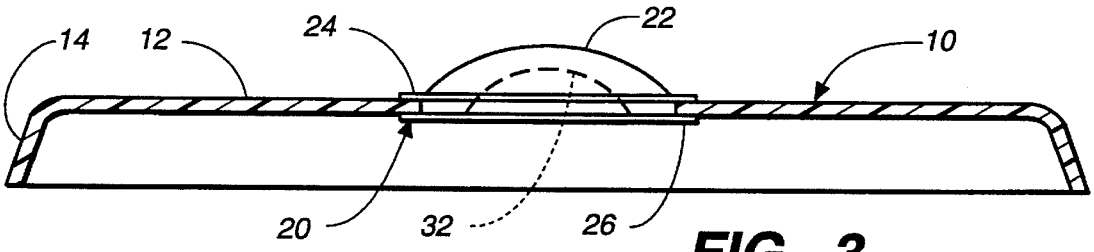
FIG. 3 is a partial cross-sectional view taken along the line 3—3 in FIG. 1 and illustrating the disc in cross section.
Figure 4:
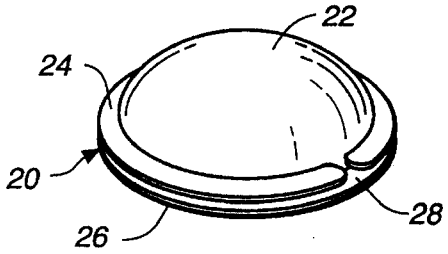
FIG. 4 is a perspective view of the container, showing details of the attachment structure thereof.

A slot 30 is formed in top wall 12 and communicates with round opening 16. Container 20 is connected to the flying disc by inserting the container from the bottom of the disc into opening 16 with the wall 22 projecting above the disc. One of the distal ends of rib 24 is passed through slot 30 and the container rotated to thread the container onto the disc until rib 24 is above the top wall and the top wall secured between the ribs as shown in FIG. 3.

In the arrangement illustrated, a depression 32 is located at the bottom of the plug-like container for accommodating the finger of a user of the apparatus. This will enable the user to support the apparatus while the apparatus is spinning.

Chemiluminescent liquid material is located within the container interior. The precise nature of the chemiluminescent fluid and the components thereof are not important; however, such material is preferably non-toxic. Such chemicals are well known. For example, a first chemiluminescent fluid component suitable for use in connection with the present invention is a mixture of Dibutyl Phthalate, CPPO (bis(2,4,5-trichloro-6-carbopentoxyphenyl)oxalate) and CBPEA (1-chloro-9,10-bix(phenylethynyl)anthracene). A suitable second chemiluminescent fluid component is a mixture of Dimethyl Phthalate, T-butyl Alcohol, hydrogen peroxide ($H_2O_2$), and Sodium Salicylate.

In practice, the components are mixed just prior to use and it will be assumed that any of the well known systems for mixing such components can be utilized. For example, it is well known to contain one of the components in a frangible capsule or container within the main container that is fractured just prior to use to mix the components. In the interest of simplicity, such an arrangement has not been illustrated and forms no part of the present invention.

The position of container 20 can be reversed, if desired, so that the dome-shaped wall is oriented downwardly and located under top wall 12. The user may, for example, wish to connect the container in such manner during the daytime. The plugging of opening 16 by container 20 will enhance the flight characteristics of disc 10.

Figure 5:
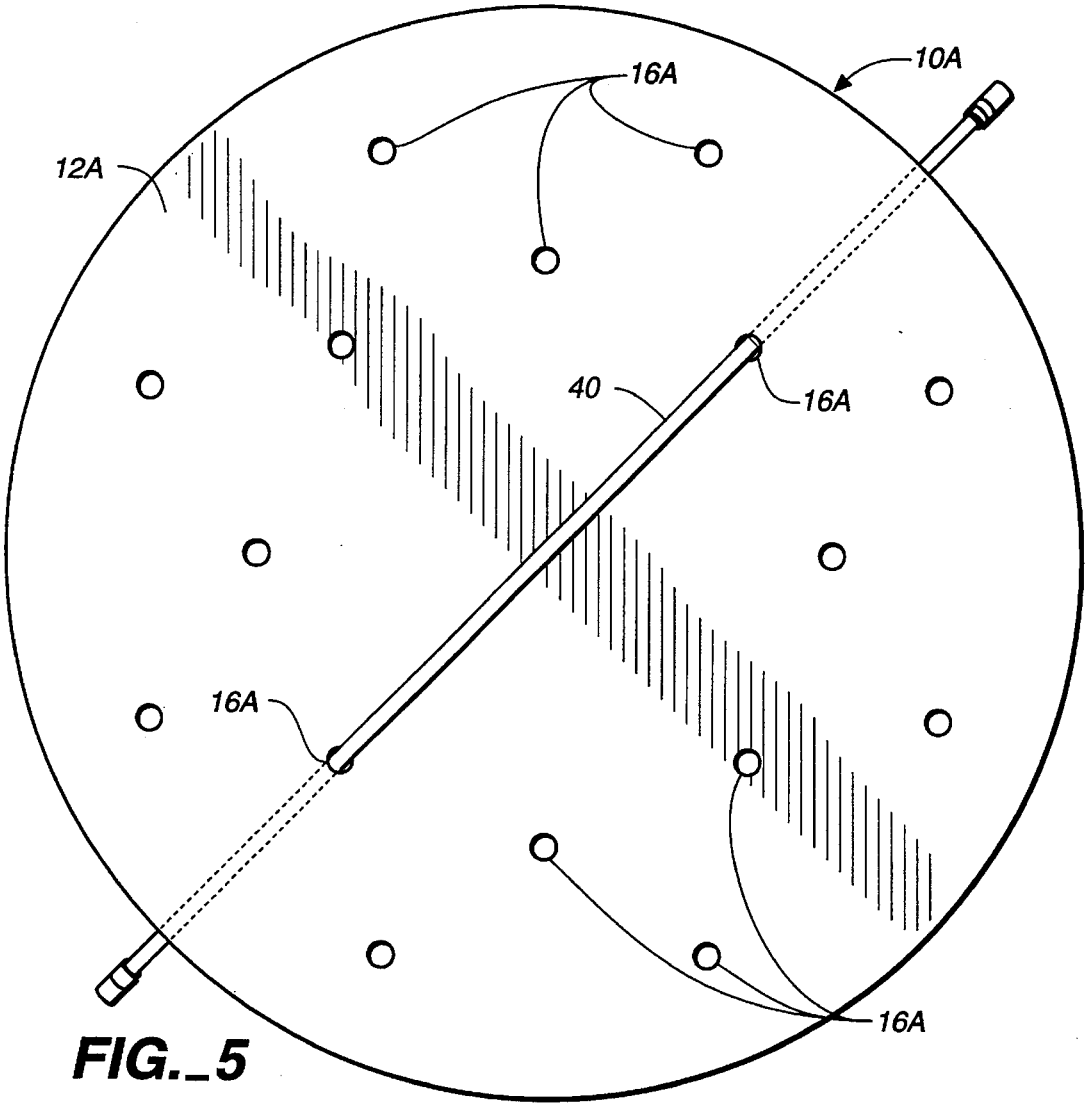
FIG. 5 is a top plan view of an alternative embodiment of the invention.
Figure 6:
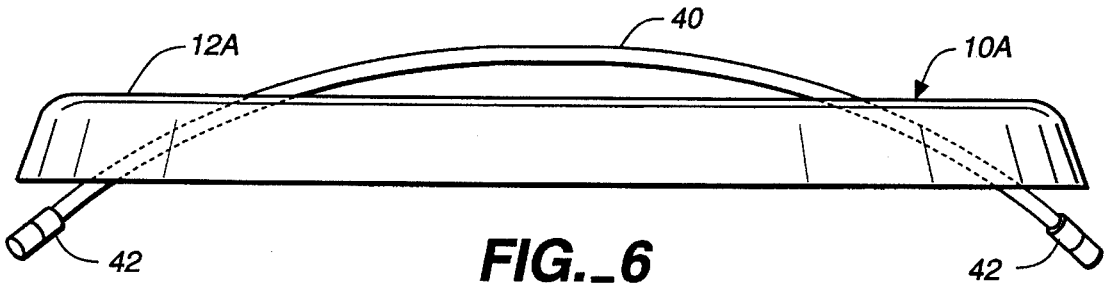
FIG. 6 is an elevational view of the alternative embodiment of FIG. 5.

FIGS. 5 and 6 disclose an alternative embodiment of the invention wherein the flying disc 10A includes a top wall 12A having a plurality of relatively small openings 16A formed therein at spaced locations. In this embodiment, the container is in the form of a tube 40 formed of flexible, light-transmitting material such as clear plastic. Tube 40 is threaded or woven through two spaced openings 16A, the flexible tube forming a bow. The ends of the tube are closed and are spaced from the rotational center of the flying disc. Furthermore, the ends are spaced from and moveable relative to the flying disc top wall. With such a configuration, the illuminated container 40 can be seen from locations above and below the top wall. Another characteristic of this disclosed embodiment adding to its interest is the fact that the free ends of the container 40 will move outwardly under centrifugal force upon rotation of the flying disc. The curved aerodynamic character of the tube means that the flight characteristics of the flying disc will not be impaired in any meaningful way.

To add further interest, whistles 42 of any suitable character actuated by passage through the air upon rotation of the disc are attached to the ends of the tube 40, thus creating an interesting sound in conjunction with the light display presented by the tube.

Figure 7:
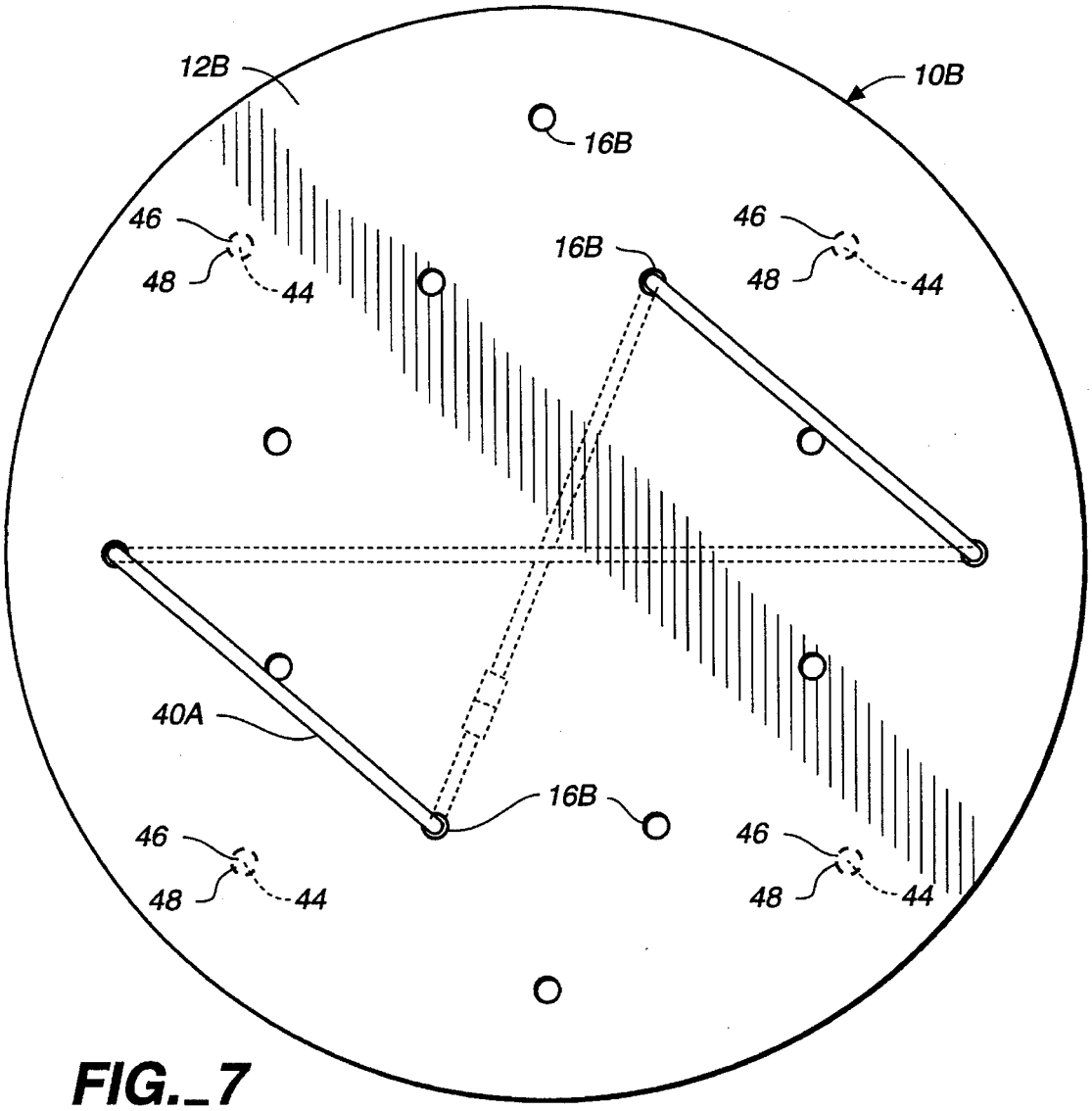
FIG. 7 is a top plan view of still another alternative embodiment of the invention.
Figure 8:
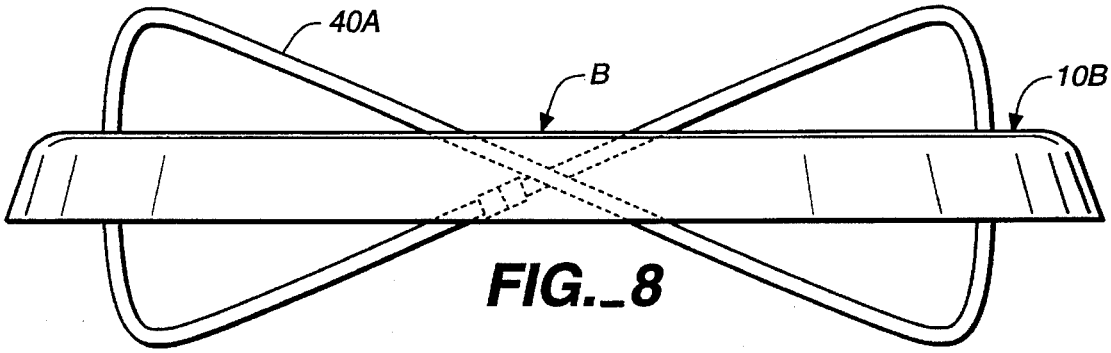
FIG. 8 is an elevational view of the embodiment of FIG. 7.

In FIGS. 7 and 8 the flying disc 10B includes a plurality of spaced openings 16B. Additionally, this embodiment includes four openings 44 which are defined by lines of weakness 46. Openings 44 are covered by removeable cover elements 48 which are integral with and removeable from the flying disc top wall upon application of external force thereto. In other words, the holes or openings 44 are closed until use thereof is desired.

In the arrangement of FIGS. 7 and 8 the tube or container 40A is woven or threaded through four of the openings 16B and the ends of the tube or container 40A connected together.

Figure 9:
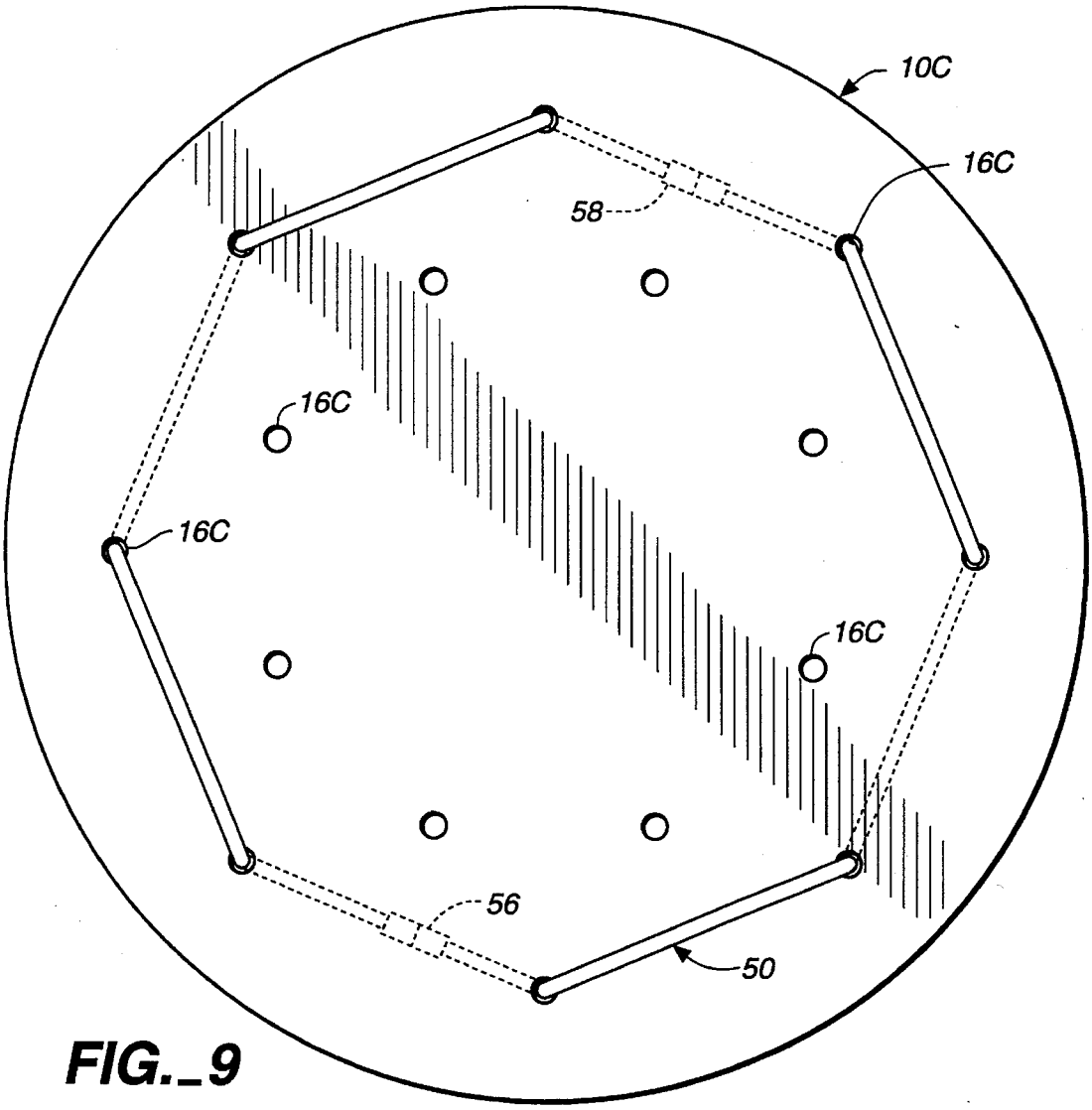
FIG. 9 is a top plan view of yet another alternative embodiment of the invention.
Figure 10:
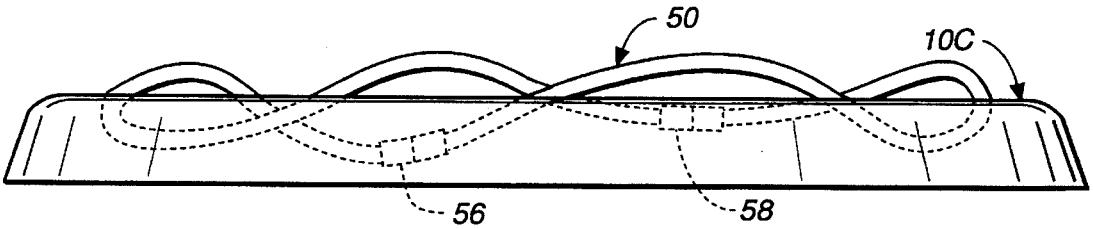
FIG. 10 is an elevational view of the embodiment of FIG. 9.

FIGS. 9 and 10 illustrate a flying disc 10C having openings 16C arrayed in spaced circles. In this embodiment the tube-like container 50 includes two tubular sections 52, 54 connected at their ends to provide a closed loop. The connected ends are designated by reference numerals 56 and 58.

Figure 11:
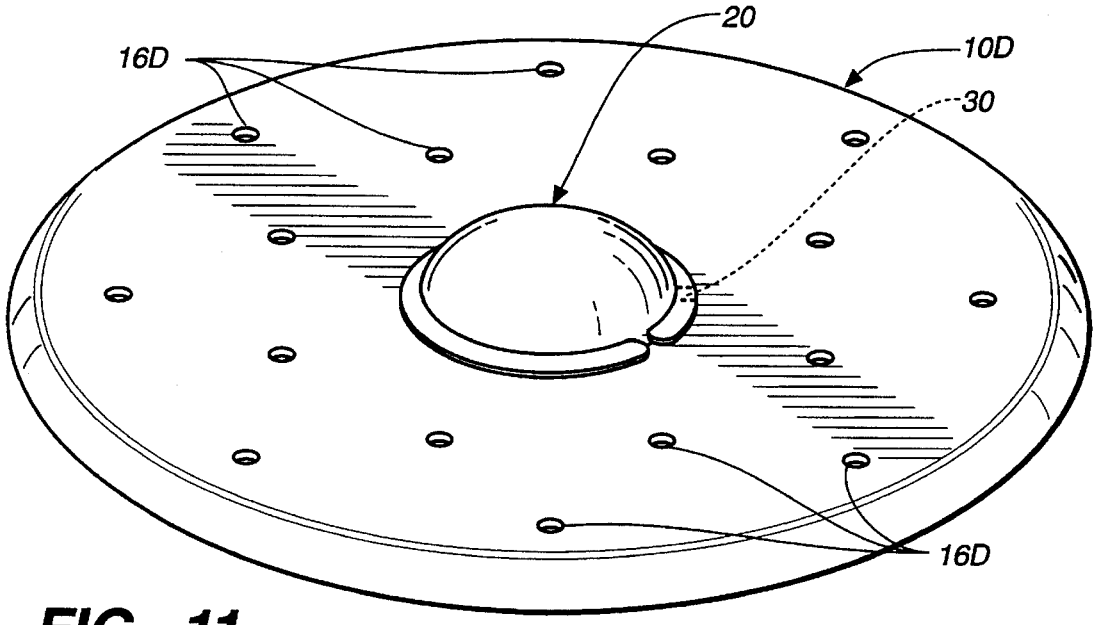
FIG. 11 illustrates the container of FIG. 4 in position on a flying disc having a plurality of holes formed in the top wall thereof.

FIG. 11 discloses an embodiment wherein the flying disc 10D has a large central opening accommodating plug-like container 20 and a plurality of smaller openings 16D which may be utilized to thread tubular containers in a manner previously described.

I claim:

1. Amusement and recreational apparatus comprising, in combination:

an aerodynamic flying disc including a flying disc top wall having a circular-shaped outer periphery and a round, continuous side wall extending downwardly from the circular-shaped outer periphery of said flying disc top wall and defining a flying disc interior with said flying disc top wall, said flying disc top wall defining at least one opening communicating with said interior;

at least one container releasably connected to said flying disc top wall and projecting through said at least one opening, said container having a curved, aerodynamic, light transmitting container wall disposed above said top wall and a container interior closed to the ambient atmosphere at least partially defined by said curved, aerodynamic, light transmitting container wall; and chemiluminescent liquid material within the container interior, rotation of said flying disc rotating said container and agitating the chemiluminescent liquid material in the closed interior of the container to provide a light display above said flying disc top wall, said flying disc top wall defining a plurality of spaced openings, and said container comprising a flexible tube woven through at least two of said spaced openings whereby said flexible tube is observable from both above and below the flying disc top wall, said flexible tube being frictionally engaged with the flying disc top wall and at least a portion of said flexible tube being spaced from the rotational center of said flying disc and spaced from and moveable relative to said flying disc top wall whereby said flexible tube portion moves outwardly under centrifugal force upon rotation of said flying disc.

2. The apparatus according to claim 1 wherein said flexible tube has two ends, said apparatus additionally comprising a whistle connected to at least one of the ends of said flexible tube.

3. The apparatus according to claim 1 wherein said flexible tube has two ends and wherein both ends of said flexible tube are spaced from the rotational center of said flying disc and spaced from said flying disc top wall whereby both of said ends move outwardly under centrifugal force upon rotation of said flying disc.

4. The apparatus according to claim 1 additionally comprising a second container comprising a plug frictionally secured to said flying disc at the center of rotation of said flying disc, said plug having a dome-shaped light transmitting container wall positionable above the flying disc top wall.

5. The apparatus according to claim 4 wherein the plug defines a depression at the bottom thereof for accommodating the finger of a user of the apparatus to support the apparatus while spinning the apparatus.

6. The apparatus according to claim 4 wherein said second container includes spaced ribs projecting outwardly away from the dome-shaped light transmitting container wall, said flying disc top wall located in the space between said ribs.

7. The apparatus according to claim 1 additionally comprising a second container comprising a plug selectively frictionally engageable with the flying disc top wall whereby said curved, aerodynamic, light transmitting container wall may be selectively positioned either above or below the flying disc top wall.

8. Amusement and recreational apparatus comprising, in combination:

an aerodynamic flying disc including a flying disc top wall having a circular-shaped outer periphery and a round, continuous side wall extending downwardly from the circular-shaped outer periphery of said flying disc top wall and defining a flying disc interior with said flying disc top wall, said flying disc top wall defining a plurality of spaced openings communicating with said interior;

a plurality of containers in frictional engagement with said flying disc top wall at a plurality of locations on said flying disc top wall and projecting through said plurality of openings, each said container having a curved, aerodynamic, light transmitting container wall disposed above said top wall and a container interior closed to the ambient atmosphere at least partially defined by said curved, aerodynamic, light transmitting container wall; and chemiluminescent liquid material within the container interior, rotation of said flying disc rotating said containers and agitating the chemiluminescent liquid material in the closed interiors of the containers to provide a light display above said flying disc top wall.

9. Amusement and recreational apparatus comprising, in combination:

an aerodynamic flying disc including a flying disc top wall having a circular-shaped outer periphery and a round, continuous side wall extending downwardly from the circular-shaped outer periphery of said flying disc top wall and defining a flying disc interior with said flying disc top wall, said flying disc top wall defining a plurality of openings communicating with said interior;

a plurality of containers releasably connected to said flying disc top wall and projecting through said openings, each said container having a curved, aerodynamic, light transmitting container wall disposed above said top wall and a container interior closed to the ambient atmosphere at least partially defined by said curved, aerodynamic, light transmitting container wall; and chemiluminescent liquid material within the container interiors, rotation of said flying disc rotating said containers and agitating the chemiluminescent liquid material in the closed interiors of the containers to provide a light display above said flying disc top wall, at least one of said plurality of containers having a tube-like configuration and being woven through a plurality of openings.

10. Amusement and recreational apparatus comprising, in combination:

an aerodynamic flying disc including a flying disc top wall having a circular-shaped outer periphery and a round, continuous side wall extending downwardly from the circular-shaped outer periphery of said flying disc top wall and defining a flying disc interior with said flying disc top wall, said flying disc top wall defining at least one opening communicating with said interior;

at least one container releasably connected to said flying disc top wall and projecting through said at least one opening, said container having a curved, aerodynamic, light transmitting container wall disposed above said top wall and a container interior closed to the ambient atmosphere at least partially defined by said curved, aerodynamic, light transmitting container wall; and chemiluminescent liquid material within the container interior, rotation of said flying disc rotating said container and agitating the chemiluminescent liquid material in the closed interior of the container to provide a light display above said flying disc top wall, said flying disc top wall defining a plurality of spaced openings, and said container comprising a flexible tube woven through at least two of said spaced openings whereby said flexible tube is observable from both above and below the flying disc top wall, and said flexible tube being comprised of a plurality of tube segments connected end-to-end.

11. Amusement and recreational apparatus comprising, in combination:

an aerodynamic flying disc including a flying disc top wall having a circular-shaped outer periphery and a round, continuous side wall extending downwardly from the circular-shaped outer periphery of said flying disc top wall and defining a flying disc interior with said flying disc top wall, said flying disc top wall having lines of weakness formed therein to define removable cover elements removable from the flying disc top wall upon application of external force thereto to form openings in said flying disc top wall communicating with said interior;

at least one container for releasable connection to said flying disc top wall and projectable through at least one opening formed in said flying disc top wall upon removal of a cover element, said container having a curved, aerodynamic, light transmitting container wall disposed above said top wall and a container interior closed to the ambient atmosphere at least partially defined by said curved, aerodynamic, light transmitting container wall; and chemiluminescent liquid material within the container interior, rotation of said flying disc rotating and agitating the chemiluminescent liquid material in the closed interior of a container releasably connected to said flying disc top wall and projecting through said at least one opening to provide a light display above said flying disc top wall.

12. Amusement and recreational apparatus comprising in combination:

a rotatable support being rotatable about an axis of rotation and defining a plurality of openings spaced from one another;

at least one flexible tube in frictional engagement with said rotatable support, said at least one flexible tube having a flexible light transmitting tube portion spaced from said rotatable support and defining an interior closed to the ambient atmosphere; and chemiluminescent liquid material within the interior of said flexible light transmitting tube portion, said at least one flexible tube being woven through at least one opening defined by said rotatable support spaced from the rotational axis of said rotatable support and said flexible light transmitting tube portion projecting from said at least one opening spaced from the rotational axis of said rotatable support whereby rotation of said rotatable support causes said flexible light transmitting tube portion to flex and move outwardly away from said rotational axis under centrifugal force to provide a variable light display from chemiluminescent light material within the interior of said flexible light transmitting tube portion.

* * * * *